US006622607B1

(12) United States Patent
Miller

(10) Patent No.: US 6,622,607 B1
(45) Date of Patent: Sep. 23, 2003

(54) MOBILE BULLET RESISTANT BARRIER

(75) Inventor: Whitney Wallace Miller, Eden Prairie, MN (US)

(73) Assignee: General Security Services Corporation, Minneapolis, MN (US)

( * ) Notice: Subject to any disclaimer, the term of this patent is extended or adjusted under 35 U.S.C. 154(b) by 0 days.

(21) Appl. No.: 10/256,363

(22) Filed: Sep. 26, 2002

(51) Int. Cl.[7] ..... F41H 7/00
(52) U.S. Cl. ..... 89/36.07; 89/36.09; 2/2.5
(58) Field of Search ..... 89/36.01, 36.07, 89/36.09; 2/2.5

(56) References Cited

U.S. PATENT DOCUMENTS 1,304,541 A * 5/1919 Clark ..... 89/36.09
4,245,546 A * 1/1981 Chaires ..... 89/36.09
4,727,789 A * 3/1988 Katsanis et al. ..... 86/50
4,781,101 A * 11/1988 Zevuluni et al. ..... 89/36.09
5,619,007 A * 4/1997 Mena et al. ..... 89/36.09
5,857,730 A * 1/1999 Korpi et al. ..... 296/146.1
6,170,379 B1 * 1/2001 Taylor ..... 89/36.07
6,367,363 B1 * 4/2002 Widmont ..... 89/36.07

* cited by examiner

*Primary Examiner*—J. Woodrow Eldred
(74) *Attorney, Agent, or Firm*—Merchant & Gould

(57) ABSTRACT

A mobile bullet-resistant barrier that has adjustable and removable bullet-resistant glass panes. The barrier includes a frame supporting a bullet-resistant material, slidable in the frame, the material being substantially transparent. The frame generally having a first frame side, a second frame side, the frame sides being substantially parallel to each other. Also, the frame includes a plurality of cross-tracks, the cross-tracks being perpendicular to the frame sides and connecting the frame sides together. Further, the frame includes a first base member and a second base member mounted perpendicular to the cross-tracks at an end of each frame side for carrying the frame sides. A plurality of locking rollers are mounted to the base members allowing frame movement.

10 Claims, 2 Drawing Sheets

MOBILE BULLET RESISTANT BARRIER

TECHNICAL FIELD

This invention relates in general to a ballistic barrier, and more particularly to a mobile bullet-resistant barrier with adjustable bullet-resistant glass panes.

BACKGROUND

Citizens and law enforcement personnel face assailants armed with firearms everyday. Of the murders committed in the U.S. with firearms, many are with a handgun. A high percentage of the time, the weapon used by assailants in committing a violent crime is a handgun. Greater gun availability increases the rates of murders and felonies. Recent studies indicate that the use of handguns in homicides has been increasing.

The selection of appropriate armor establishes a level of protection. This level of protection must meet the needs of the user and be based upon a realistic weapon threat. Notwithstanding, it is impossible to completely protect a law enforcement officer, or group of law enforcement officers, from all possible firearm threats with body armor. It is therefore necessary to also use a reasonable level of ballistic protection as an alternative or additional means while minimizing the risk of injury resulting from firearms.

Police departments, to date, have been minimizing the risk of potential injury resulting from criminal use of handguns using non-ballistic shields, non-see-through ballistic shields with limited viewing lens plates, ballistic face shields, and bullet-resistant vests made from a wide variety of armor, such as polyethylene, polycarbonate, aluminum alloys, and steel. For example, U.S. Pat. No. 5,641,934 discloses a completely transparent bullet shield. U.S. Pat. Nos. 4,412,495 and 5,392,686 disclose full body bulletproof shields. All of these patents are directed to hand held bulletproof shields.

The problem with these hand-held shields is that they are cumbersome and may block the view of the user, thereby jeopardizing the safety of the user and those around him. In addition, these shields typically only protect part of a single person's body leaving that person and others around him/her vulnerable to an assailant. Further, these shields lack the ability to protect larger high threat areas while simultaneously providing full view of immediate and potential threats. The shields also lack the ability to create a ballistic barrier having an unobstructed view in larger areas such as doorway areas involving explosions and flying debris, vicinities of riot, embassies grounds, and other high risk locations.

It can be seen then that there is a need for a bullet-resistant barrier that protects a larger area than a hand-held shield and is mobile. Such a mobile bullet-resistant barrier would need to have the ability to protect a larger area while simultaneously providing a full view of immediate and potential threats. Such a mobile bullet-resistant barrier would need to protect not only a person, but also an area from hazards such as gunfire, or an explosion. Such a mobile bullet-resistant barrier would create a refuge or haven for an entire area, unlike a hand-held shield.

SUMMARY

An apparatus in accordance with the principles of the present invention includes a mobile bullet-resistant barrier including a frame having a first frame side, a second frame side, and the frame sides being substantially parallel to each other. The frame also includes a plurality of cross-tracks, the cross-tracks being perpendicular to the frame sides and connecting the frame sides together. Further, the frame includes a first base member and a second base member mounted perpendicular to the cross-tracks at an end of each frame side for carrying the frame sides. A plurality of rollers are mounted to the base members allowing omni directional frame movement. The frame supports a bullet-resistant material, slidable in the frame, the material being substantially transparent.

Other embodiments of an apparatus in accordance with the principles of the invention may include alternative or optional additional aspects. One such aspect would be an apparatus including a mechanism allowing retraction and extension of the plurality of rollers mounted to the first and second base member, the plurality of rollers further including a locking mechanism inhibiting movement of the rollers. Another aspect would be an apparatus including a roller assembly that is removable, allowing the barrier to rest on its frame.

Another aspect of the present invention is that the cross-tracks support at least one panel of bullet-resistant material in the frame. The cross-tracks are adjustable, allowing movement of the bullet-resistant material in the frame.

Another aspect of the present invention is that the frame further includes a latch for maintaining a predetermined position of the cross-track, inhibiting the movement of the bullet-resistant material in at least one direction.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the present invention.

BRIEF DESCRIPTION OF THE DRAWINGS

Referring now to the drawings in which like reference numbers represent corresponding parts throughout.

DETAILED DESCRIPTION

To overcome the limitations in the prior art described above, and to overcome other limitations that will become apparent upon reading and understanding the present specification, the present invention discloses a bullet-resistant barrier, and more particularly a mobile bullet-resistant barrier with adjustable bullet-resistant glass panes.

The present invention solves the above-described problems by providing a mobile bullet-resistant barrier with adjustable bullet-resistant glass panes that have the ability to protect larger high threat areas and provides full view of immediate and potential threats.

In the following description of the exemplary embodiment, reference is made to the accompanying drawings, which form a part hereof, and in which is shown by way of illustration the specific embodiment in which the invention may be practiced. It is to be understood that other embodiments may be utilized as structural changes may be made without departing from the scope of the present invention.

Figure 1:
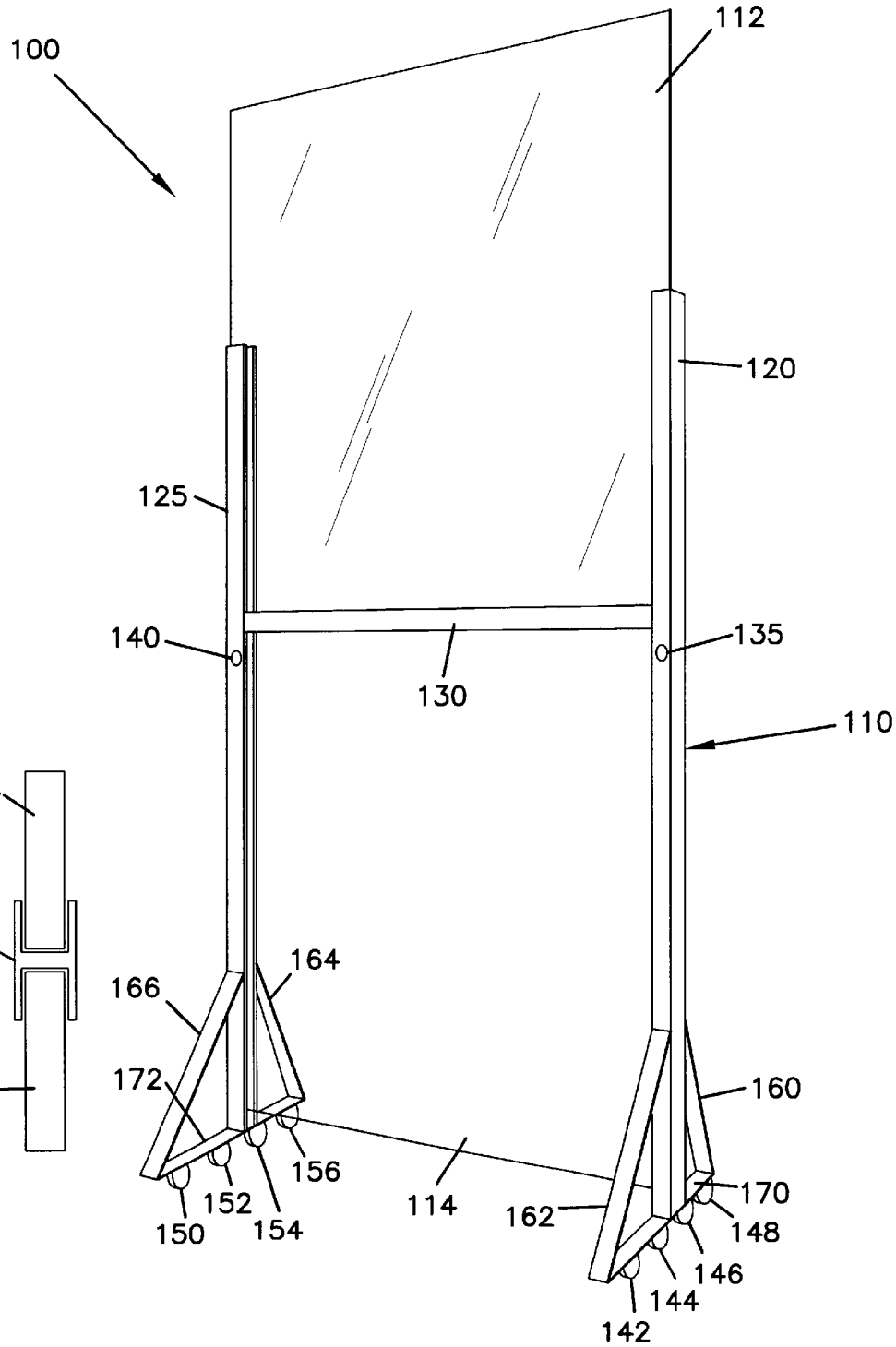
FIG. 1 is a diagram of a mobile bullet-resistant barrier according to the present invention.

Generally, the present invention includes at least a transparent bullet-resistant pane resting upon a rolling assembly. Referring to the drawings in detail wherein like numerals designate like parts, FIG. 1 illustrates a portable mobile bullet-resistant barrier 100 according to the present invention. In accordance with one embodiment of the invention, the mobile bullet- resistant barrier includes a frame 110, an upper transparent bullet-resistant pane (upper pane) 1112, and a lower bullet-resistant pane (lower pane) 114, which in an alternative embodiment is transparent. In the present embodiment, the upper transparent bullet-resistant pane 112 may be comprised of bullet-resistant material such as 5 mm Victoreen clear PH lead plastic (12 mm lead equivalent). From the teachings provided herein, those skilled in the art appreciate that the foregoing description sets forth one embodiment of the invention comprised of one type of transparent bullet-resistant material. It is to be understood that other types of bullet-resistant materials may be used in the present invention. The use of transparent bullet-resistant material is not intended in any way to limit the scope of the invention. It is contemplated that shield may be comprised of any number of materials, some of which may not be transparent so long as the materials are bullet-resistant and provide the user of the shield to see a potential threat from a plurality of angles.

The frame includes a first frame side 120 and a second frame side 125 having generally the form of a channel, such as a "U" channel. The "U" shaped channel assists with positioning and stabilization of the bullet-resistant material. In the present embodiment, the first frame side 120 is about 1/16 inch thick. However, it is to be understood that in alternative embodiments, the thickness of the first frame side may be different and may depend on the thickness and weight of the bullet resistant panel. The first side 120 and the second side 125 are joined by a cross-track. In the embodiment illustrated in FIG. 1, the cross-track 130 generally has the form of an "I" channel and is attached towards the middle of the first frame side 120 and the second frame side 125. In other embodiments, the cross-track 130 may be constructed by joining two "U" shaped cross tracks together as described in detail below in FIG. 2. Alternatively, the cross-track 130 may be attached anywhere along the first frame side 120 and the second frame side 125. When the cross-track 130 is attached at the bottom of the first frame side 120 and the second frame side 125 the configuration of cross-track 130 will "U" shaped.

In another embodiment, the upper transparent bullet-resistant pane (upper pane) 112, and a lower bullet-resistant pane (lower pane) 114, comprises a single pane that is removably attached to the first frame side 120 and the second frame side 125 without the use of a cross-track. In this embodiment, the single pane may be bolted in place by sliding the single pane through the "U" shape of the first frame side 120 and the second frame side 125, aligning orifices that have matching positions on the single pane and the first frame side 120 and the second frame side 125 and passing a bolt through the matching positioned orifices and securing the single pane in place.

In the embodiment illustrated in FIG. 1, the first and second frame sides 120, 125 are attached to and supported by a first base member 170 and a second base member 172. The first base member 170 and a second base member 172 are attached perpendicularly to the first and second frame sides 120, 125 and extend in front of and behind the upper 112 and lower 114 pane faces to provide balancing support. The first frame side 120 is supported by support members 160, 162, attached to the base member 170 at one end and to the first frame side 120 at the other, generally forming an oblique angel between the base member 170 and the first frame side 120. Also, the second frame side 125 is supported by support members 164, 166, attached to the base member 172 at one end and to the second frame side 125 at the other, generally forming an oblique angel between the base member 172 and the first frame side 125.

The base members 170, 172 are supported by a plurality of ground-engaging rollers 142, 144, 146, 148, 150, 152, 154, 156. In the present embodiment base members 170, 172 are supported by eight ground engaging rollers such as caster wheels assemblies. It is to be understood that the ground engaging rollers may be any wheel assembly so long as the wheels render the bullet resistant barrier steerable. In one embodiment the rollers 142–156 may be retractable thereby allowing the base members 170, 172 to rest firmly on the ground or at some height intermediate. The rollers 142–156 may also be locked in position restricting omni directional movement of the frame 110.

Carried by the frame 110 is the lower pane 114, which is slidable within the channels of the first and second frame sides 120, 125 and supported by the base members 170, 172, support members 160–166 and cross-track 130. The upper pane 112 is slidable in the first and second frame side 120, 125 channels and supported at its bottom by a channel created by the "I" beam construction of the cross-track 130.

In another embodiment, a plurality of cross-tracks 130 may be utilized, each cross-track supporting a bullet-resistant material, each slidable within the first and second frame sides 120, 125. A plurality of latches, such as frame latches 135, 140, may be used to secure the plurality of cross-tracts 130 at some predetermined position in the frame 110.

Figure 2:
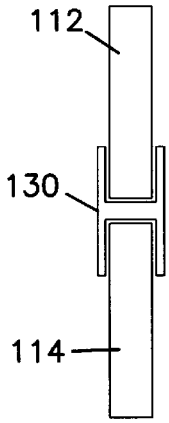
FIG. 2 is a detailed diagram of a mobile bullet-resistant barrier cross-track according to the present invention.

FIG. 2 is a detailed diagram of a mobile bullet-resistant barrier cross-track 130 according to the present invention. One embodiment illustrates the cross-track 130 channel may be formed generally in the shape of an "I" channel. This cross-track 130 may be constructed by joining two "U" shaped channels. The channels may be joined by riveting or welding the two channels at their faces generally forming the "I" channel as illustrated in FIG. 2. From the teachings provided herein, those skilled in the art appreciate that the foregoing description sets forth one embodiment and one example of constructing the cross-track 130, although other processes such as extrusion, and channel shapes, such as concave, may be used.

The lower pane 114 is supported by the cross-track 130 at the lower panes upper edge. The lower pane 114 fits into one channel of the cross-track 130, being supported on three sides. The upper pane 112 is also supported by the cross-track 130 at its lower edge. The upper pane 112 fits into the vacant channel of the cross-track 130, being supported on three sides. The cross-track 130 is slidable in the vertical plane of the channels of the first and second frame sides 120, 125.

Latches 135, 140 may be used to adjust the position of the cross-track 130 in the frame 110, thereby repositioning the upper pane 112 in frame 110. In one embodiment, bolts may be used for the latches 135, 140. The bolts would pass through one of a plurality of holes in the first and second frame sides 120, 125. When the latches 135, 140 are installed in frame 110, the cross-track 130 is supported by the latches 135, 140, thus supporting the upper pane.

Figure 3:
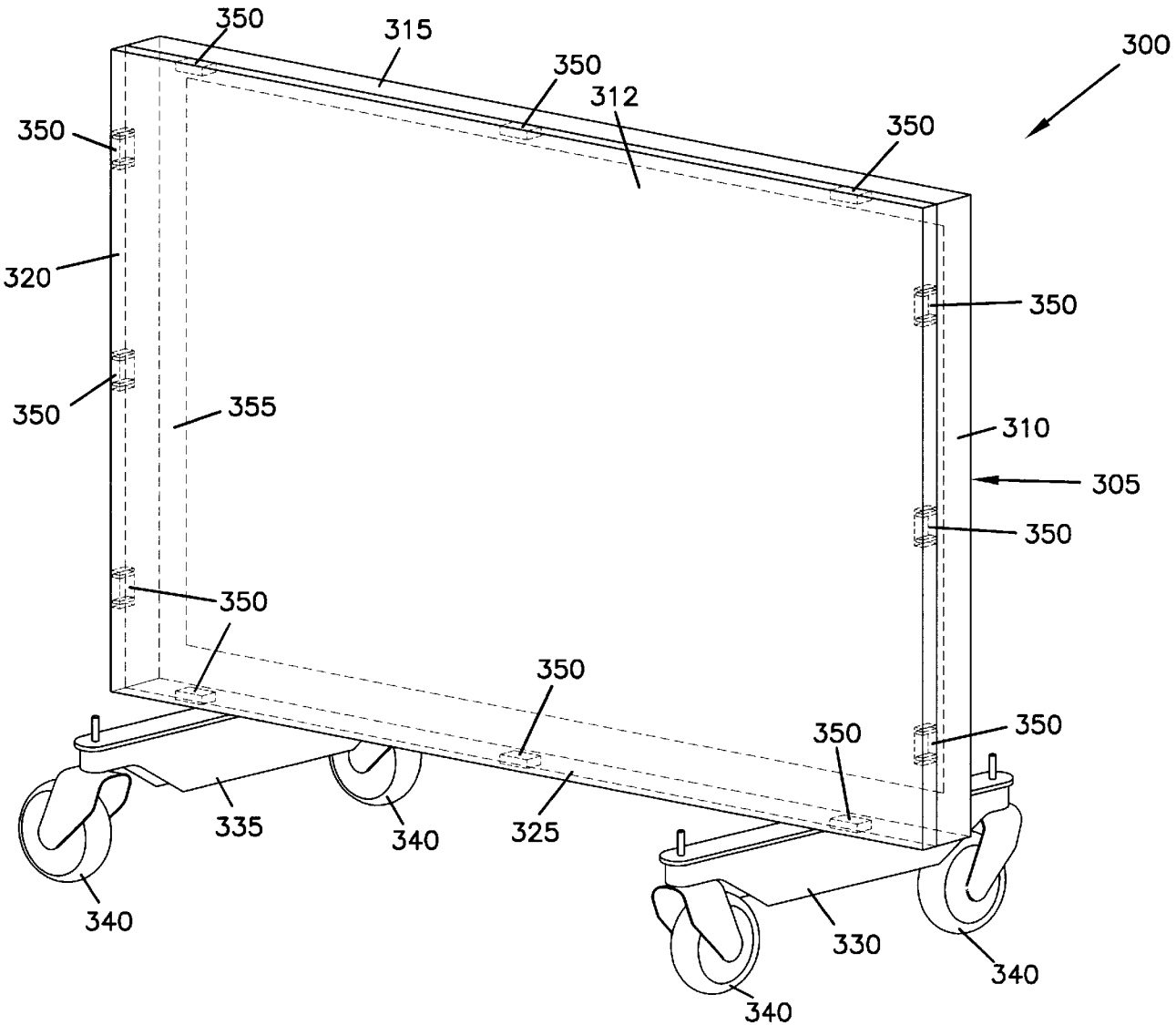
FIG. 3 is an embodiment of the mobile bullet-resistant barrier according to the present invention.

FIG. 3 is another embodiment of a mobile bullet-resistant barrier in accordance with the present invention. The frame 305 having generally the form of a rectilinear box has a top frame member 315, a bottom frame member 325, a first side member 310 and a second side member 320.

The frame is carried by a first support member 330 and a second support member 335, which is connected to the bottom frame member 325. The lower frame member 325 is supported substantially close to either of its ends by the first support member 330 and the second support member 335, the lower frame member 325 resting perpendicular and central to each supporting member 330, 335. Each supporting member 330, 335 is supported at each of its forward corners by a roller such as ground-engaging caster wheels 340, whereby the frame 305 is rendered steerable.

The frame members, top frame member 315, bottom frame member 325, first side member 310, second side member 320, are connected to form the rectilinear box by a process such as riveting and welding. From the teachings provided herein, those skilled in the art appreciate that the foregoing description sets forth one embodiment and one example of constructing the frame 305, although other processes, such as extrusion, may be used.

Each frame member generally having the form of a right angle, when connected to another frame member, forms a flange 355 when all frame members are connected together allowing the bullet-resistant material 312 to mount flush to the flange 355 by sliding the bullet-resistant material 312 from the rear of the frame 305 to the mating flange surface 355. The pane 312 is then secured by a plurality of retaining blocks 350 secured to the inner side of the frame 305 securing the pane 312 between the flange 355 and the mounting blocks 350.

In another embodiment the rollers 340 may be retractable thereby allowing the support members 330, 335 to rest firmly on the ground or at some height intermediate. The rollers may also be locked in position restricting omni directional movement of the frame 305.

Although it has been shown and described a specific embodiment of the invention, it would be apparent that many minor changes of structure and operations could be made without departing from the spirit of the invention as defined by the scope of the appended claims.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A mobile bullet-resistant barrier, comprising:

a frame having a first frame side and a second frame side, said first and second frame sides being substantially parallel to each other;

a substantially transparent bullet-resistant material attached to said first and second frame sides;

a first base member and a second base member mounted perpendicular to said frame and providing support for said frame sides; and a plurality of rollers mounted to said first and second base members.

2. The barrier of claim 1, wherein said first base member is rigidly mounted to the lower end of said first frame side and a second base member is rigidly mounted to the lower end of said second frame side, said base members being perpendicular to said first and second frame sides and attached substantially close to each of said base members midpoint.

3. The barrier of claim 1, wherein said plurality of rollers mounted to said first and second base member further comprises a mechanism allowing retraction and extension of said plurality of rollers.

4. The barrier of claim 1, wherein said plurality of rollers further comprises a locking mechanism inhibiting movement of said rollers.

5. The barrier of claim 1, wherein said frame further comprises a positioning channel, said positioning channel supporting the movement of said bullet-resistant material in a plane parallel to said first and second frame sides.

6. The barrier of claim 1, wherein said frame includes at least one cross-track that is perpendicular and connected to said first and second frame sides.

7. The barrier of claim 6, wherein said at least one cross-track supports at least one pane of bullet-resistant material in said frame.

8. The barrier of claim 6, wherein said at least one cross-track is adjustable, allowing said bullet-resistant material to be positioned at varying heights within said frame.

9. The barrier of claim 6, wherein said frame further comprises latches for maintaining a predetermined position of said at least one cross-track in said frame, wherein said bullet-resistant material is inhibited from moving in at least one direction.

10. The barrier of claim 1, wherein said frame further comprises support members for supporting said first and second frame sides, said support members being attached to said base members at one end and to said first and second frame sides at the other end and forming an oblique angel between said base members and said first and second frame sides.

* * * * *